US009433545B2

(12) United States Patent
Isik

(10) Patent No.: US 9,433,545 B2
(45) Date of Patent: Sep. 6, 2016

(54) WHEELCHAIR

(71) Applicant: Hasan Hüseyin Isik, Wil (CH)

(72) Inventor: Hasan Hüseyin Isik, Wil (CH)

( * ) Notice: Subject to any disclaimer, the term of this patent is extended or adjusted under 35 U.S.C. 154(b) by 0 days.

(21) Appl. No.: 14/411,134

(22) PCT Filed: Jun. 24, 2013

(86) PCT No.: PCT/CH2013/000111
§ 371 (c)(1),
(2) Date: Dec. 24, 2014

(87) PCT Pub. No.: WO2014/000115
PCT Pub. Date: Jan. 3, 2014

(65) Prior Publication Data

US 2015/0150738 A1 Jun. 4, 2015

(30) Foreign Application Priority Data

Jun. 27, 2012 (CH) ..... 902/12

(51) Int. Cl.
*A61G 5/02* (2006.01)
*A61G 5/10* (2006.01)

(52) U.S. Cl.
CPC ..... *A61G 5/021* (2013.01); *A61G 5/023* (2013.01); *A61G 5/024* (2013.01); *A61G 2005/1054* (2013.01)

(58) Field of Classification Search
CPC ..... A61G 5/021; A61G 5/024; A61G 5/023
USPC ..... 280/252, 254, 256, 259, 250.1
See application file for complete search history.

(56) References Cited

U.S. PATENT DOCUMENTS

| | | | | |
|---|---|---|---|---|
| 98,819 | A * | 1/1870 | Wanner | B62M 1/24 280/252 |
| 2,643,898 | A * | 6/1953 | Everest | A61G 5/023 280/240 |
| 3,666,292 | A * | 5/1972 | Bartos | A61G 5/006 280/234 |
| 4,421,336 | A | 12/1983 | Petrofsky et al. | |
| 6,220,615 | B1 * | 4/2001 | Chubbuck | A61G 5/02 280/255 |
| 7,922,187 | B2 * | 4/2011 | Fremgen | A61G 5/023 280/250.1 |
| 8,251,393 | B2 * | 8/2012 | Fremgen | A61G 5/023 280/250.1 |
| 2008/0238023 | A1 * | 10/2008 | Bloom | A61G 5/023 280/250.1 |
| 2010/0156063 | A1 * | 6/2010 | Green | A61G 5/025 280/248 |

FOREIGN PATENT DOCUMENTS

| | | |
|---|---|---|
| DE | 3201310 | 7/1983 |
| DE | 81124 | 10/1984 |

(Continued)

OTHER PUBLICATIONS

International Search Report, dated Sep. 12, 2013.

*Primary Examiner* — Tony Winner
(74) *Attorney, Agent, or Firm* — Dority & Manning, P.A.

(57) ABSTRACT

A wheelchair has an additional auxiliary drive device that allows the wheelchair to be moved even without using one's hands. Two drive wheels are connected by means of a wheel hub and one wheel is arranged at one side of a wheelchair frame and the other wheel at the opposite side of the wheelchair frame. A seat is arranged between the drive wheels, the seat surface of which is arranged such that it can be tilted along the wheel axis of the drive wheels, wherein the tilting axis of the seat is located centrally between the drive wheels above the wheel axis.

9 Claims, 3 Drawing Sheets

(56) References Cited

FOREIGN PATENT DOCUMENTS

| | | |
|---|---|---|
| DE | 3827 153 C1 | 8/1989 |
| DE | 20 2007 008 736 U1 | 10/2007 |
| DE | 20 2008 017 474 U1 | 10/2009 |
| DE | 20 2010 005 729 U1 | 8/2010 |
| EP | 0 282 118 B1 | 8/1991 |
| FR | 506.911 | 9/1920 |
| GB | 5907 | 0/1910 |

* cited by examiner

WHEELCHAIR

CROSS-REFERENCE TO RELATED APPLICATIONS

This application claims priority to International Application Serial No. PCT/CH2013/000111, filed Jun. 24, 2013, which claims priority to Swiss Patent Application No. CH 902/12 filed Jun. 27, 2012. International Application Serial No. PCT/CH2013/000111 is hereby incorporated herein for all purposes by this reference.

FIELD OF THE INVENTION

The invention relates to a wheelchair, especially a wheelchair with an additional auxiliary drive means.

BACKGROUND

A conventional wheelchair comprises a chair frame with a seating area between two large drive wheels, as well as two smaller auxiliary wheels and foot rests in front of them. The drive wheels are on their outer side provided with a drive ring, which in turn is connected to the wheel rim. The drive rings are rotated with the hands, allowing independent locomotion without third party.

Since this locomotion requires a high degree of effort, a drive was proposed in DE-U 202010005729, which would allow a power-saving and safe handling. This is done by a drive lever which is hinged to the wheel axles of the drive wheels and can be swung back and forth about the wheel axis. The drive levers reach out over the radius of the drive wheel and are provided with a handle and a brake. The pivotal movement of a drive lever is limited by an extension arm guided in a longitudinal slot of a protection plate.

In DE-U-202008017474, a drive motor is arranged in the axis of the drive wheels, to support the manual driving force, wherein a control device is provided, which comprises an anti-back-roll mode of operation.

In a similar solution according to DE-U-202007008736, each drive wheel is part of a drive wheel module with a drive power unit arranged in the body frame of the wheelchair, in order to minimize the width of the wheelchair.

In order to move forward, the person seated in the wheelchair must use at least one hand to rotate a drive ring of a drive wheel and/or operate the control device of a drive power unit.

SUMMARY OF THE INVENTION

It is therefore an object of the invention, to avoid the disadvantages of the prior art and to propose a wheelchair, notably a wheelchair with an additional auxiliary drive means, which may also allow movement of the wheelchair without using the hands.

This problem is solved with the features described more fully below. To a conventional wheelchair is added a seat tiltable along the axle of the drive wheels in the direction of the drive wheels and/or transverse thereto, wherein the tilting axis of the seat is located centrally between the drive wheels and above the wheel axle.

Preferably, the seat is connected to the wheel shaft of the drive wheels by lever joints, tooth rack/gear drives or thereto similar drives. The drive can also be supplemented with an electric drive, an air motor or thereto similar drives.

If the tilting movement is perpendicular to the axle of the drive wheels, the backrest may also be designed tiltable, similar to handcars or draisines.

Further preferred embodiments are disclosed herein. Thus, the wheelshaft can be designed as a crankshaft, with its deflection preferably formed at an angle or being curved in order to avoid dead spots, or it comprises a cam-follower arrangement.

Each drive wheel comprises a standard drive ring and/or a drive lever.

When using toothed rack/gear drives, the wheel shaft is straight, the levers are designed as toothed racks and on each side on the wheel shaft even stepped gears can be arranged next to each other, so that there is a gear shift. Likewise, the seat bottom could be constructed as a gear segment, corresponding with a horizontally arranged toothed rack whose ends are in turn connected to levers or toothed racks.

By means of the invention, a wheelchair can be moved by a tilting movement of the seat transverse to the direction of travel so that the hands remain free e.g., for a ball game or another activity, or even disabled hands do not represent a problem. Such a wheelchair is also suitable for driving backwards. The mobility of the wheelchair user is thus considerably extended.

This type of lever joints or crank-rocker mechanisms are in principle known from handcars or draisines. In DE-A-3201310, for example, a drive device for bicycles with lever joints is described. On both sides of the bike such a drive device is mounted to avoid a dead spots when using the pedals.

In any case, the actuation of the lever joints or the crank-rocker mechanisms is performed solely by hand or leg movements. Alternatively or in addition, several drives are conceivable, e.g., electric drives.

It is possible to transfer the tiltable seat and the drive according to the invention to bicycles. Thereby, a supplementary drive acting on the rear wheel would be achieved by tilting the seat, while keeping the pedal and chain drive.

BRIEF DESCRIPTION OF THE DRAWINGS

An embodiment of the invention will now be described closer with reference to a drawing. The figures show.

DESCRIPTION OF EXEMPLARY EMBODIMENTS THE INVENTION

Figure 1:
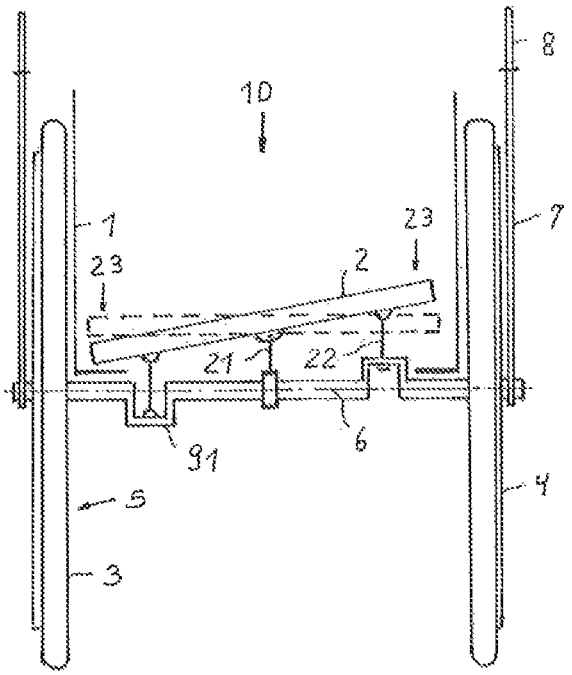
FIG. 1: a wheelchair with an auxiliary drive arrangement.

As shown in FIG. 1, a conventional wheelchair can include components such as an only indicated chair frame 1 with a seating area 2 between two large drive wheels 3, as well as two conventional smaller auxiliary wheels and foot rests (not shown) in front of them. The drive wheels 3 are on their outer side provided with a drive ring 4, which in turn is connected to the wheel rim 5. The drive rings 4 can be rotated with the hands of the seated person 10 allowing an independent locomotion without third party.

Additionally, drive levers 7 are mounted outside to the wheel axles 6 of the drive wheels 3, pivotable back and forth about the wheel axles or designed as is as crank-rocker mechanism. The drive levers 7 extend beyond the radius of the drive wheel 3 and are provided with a handle 8.

Figure 2A:
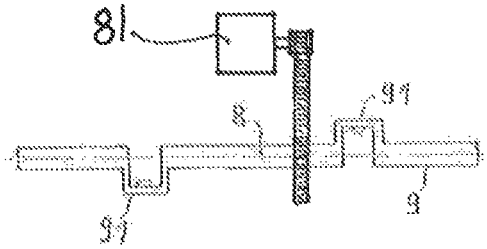
FIG. 2*a*: a detailed view of a side elevation the auxiliary drive arrangement.
Figure 2B:
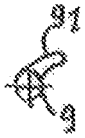
FIG. 2*b*: a detailed view of an end elevation of the auxiliary drive arrangement shown on FIG. 2*a*.

In an exemplary embodiment of the present invention, the seating area 2 is arranged on a pivot bearing 21 above the crank-rocker-mechanism-like wheel shaft 9 in an articulatable or tiltable manner with respect to the wheel axles 6. On each of the outer portions 23 of the seating area 2 opposite the respective drive wheel 3 a lever 22 is hinged, being pivotably connected to a deflection 91 of the wheel shaft 9 (FIGS. 2*a* and 2*b*). As shown in FIG. 2*b*, the deflection 91 is formed at an angle or curved.

If the outer portion 23 is tilted downwards due to a tilting movement triggered by a driving person, the hinged lever 22 is pressed downwards, resulting in a rotation of the wheel shaft 9 and thereby the drive wheels 3, caused by the deflection 91. At the same time the other lever 22 is pulled upwards. A subsequent tilting movement of the seating area 2 in the opposite direction presses the other lever 22 downwards and causes further rotation of the wheel shaft 9. As schematically shown in FIG. 2*a*, the drive can also be supplemented with an electric drive unit 81.

Figure 3:
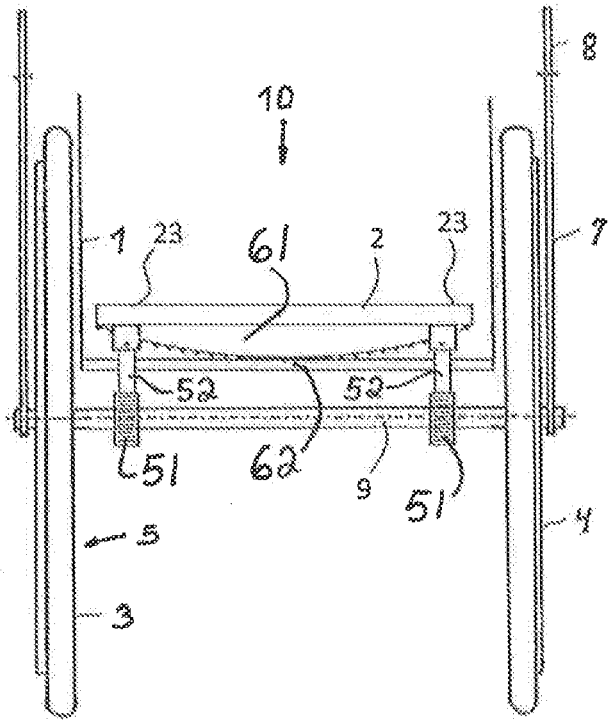
FIG. 3: a view as in FIG. 2*a* but with an alternative embodiment of the auxiliary drive arrangement.

As schematically shown in FIG. 3, in each of the outer portions of the seating area, a toothed rack 52 is hinged, corresponding with a respective gear 51 on the wheel shaft 9. When using toothed rack/gear drives, the wheel shaft 9 is straight, the levers are designed as toothed racks 62. An underside of the seating area is constructed as a gear segment 61, corresponding with a horizontally arranged toothed rack 62.

The wheelchair is driven by the tilting motion of the seating area 2 and is controlled by the speed differences on the driving wheels 3. The wheelchair can be driven forwards and backwards in driving direction and can overcome slopes of up to 20 degrees.

Normal wheel parking brakes are used as a roll-away protection. A service brake is provided by actuation of the hand lever (drive lever 7) and/or a movement of the back. A pressure point against accidental actuation is possible, as well as recuperation of braking energy.

LIST OF REFERENCE SIGNS

1 chair frame
2 seating area
3 drive wheel
4 drive ring
5 wheel rim
6 wheel axle
7 drive lever
8 handle
9 wheel shaft
10 person
21 pivot bearing
22 lever
23 outer portion
91 deflection

The invention claimed is:

1. A wheelchair provided with an auxiliary drive device for hands-free propulsion of the wheelchair, comprising:

at least one chair frame, the auxiliary drive device having laterally arranged drive wheels, which are connected to a wheel shaft and rotatable about a wheel axis, a seat arranged between the drive wheels, a pair of auxiliary wheels disposed beneath the seat for supporting the weight of a user carried on the seat and spaced apart from the drive wheels, wherein a seating area of the seat is arranged to be tiltable about a tilting axis that extends in a direction that is transverse to the wheel axis of the drive wheels, the tilting axis of the seat being in a middle between the driving wheels and above the wheel shaft; and wherein the seat is connected to the wheel shaft of the drive wheels by lever joints, tooth rack drives or gear drives, such that movement of the wheelchair in a first direction is effected by tilting the seat in a tilting direction that is transverse to the first direction of movement of the wheelchair.

2. A wheelchair according to claim 1, wherein the seat is tiltable in at least two directions.

3. A wheelchair according to claim 1, wherein the wheel shaft is formed as a crank shaft.

4. A wheelchair according to claim 1, wherein the wheel shaft is formed as a crank shaft and in each of the outer portions of the seating area a lever is hinged, which is pivotally connected to a respective deflection of the crank shaft.

5. A wheelchair according to claim 1, wherein in each of the outer portions of the seating area, a toothed rack is hinged, corresponding with a respective gear on the wheel shaft.

6. A wheelchair according to claim 1, wherein an underside of the seating area is constructed as a gear segment, corresponding with a horizontally arranged toothed rack.

7. A wheelchair according to claim 1, wherein each drive wheel has a wheel axle connected to the wheel shaft and wherein an additional drive lever is mounted outside on each wheel axle of the driving wheels.

8. A wheelchair according to claim 1, wherein an additional drive unit is assigned to the driving wheels, and this additional drive unit is selectively engageable by the user to power the driving wheels.

9. A wheelchair according to claim 1, wherein the wheel shaft is straight.

* * * * *